US007441947B2

(12) United States Patent
Liu et al.

(10) Patent No.: US 7,441,947 B2
(45) Date of Patent: Oct. 28, 2008

(54) PERFORMANCE TESTING APPARATUS FOR HEAT PIPES

(75) Inventors: Tay-Jian Liu, Tu-Cheng (TW); Chao-Nien Tung, Tu-Cheng (TW); Chih-Hsien Sun, Tu-Cheng (TW); Chuen-Shu Hou, Tu-Cheng (TW); Cheng-Chi Lee, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 174 days.

(21) Appl. No.: 11/309,314

(22) Filed: Jul. 25, 2006

(65) Prior Publication Data

US 2007/0147465 A1 Jun. 28, 2007

(30) Foreign Application Priority Data

Dec. 28, 2005 (CN) ..... 2005 1 0121388

(51) Int. Cl.
*G01N 25/20* (2006.01)
*G01K 17/06* (2006.01)

(52) U.S. Cl. ..... 374/29; 374/5; 374/147; 374/208

(58) Field of Classification Search ..... 374/4, 374/5, 29–32, 43, 44, 57, 137, 152, 208, 374/179, 147, 39
See application file for complete search history.

(56) References Cited

U.S. PATENT DOCUMENTS

| | | | | |
|---|---|---|---|---|
| 4,067,237 | A * | 1/1978 | Arcella | 73/204.23 |
| 4,595,297 | A * | 6/1986 | Liu et al. | 374/29 |
| 5,248,198 | A * | 9/1993 | Droege | 374/7 |
| 5,355,683 | A * | 10/1994 | Taylor | 62/51.1 |
| 5,707,152 | A * | 1/1998 | Krywitsky | 374/208 |
| 7,147,368 | B2 * | 12/2006 | Chien | 374/147 |
| 7,304,848 | B2 * | 12/2007 | Chang | 361/701 |
| 2002/0053172 | A1 * | 5/2002 | Castillejo | 52/36.2 |

* cited by examiner

*Primary Examiner*—Gail Verbitsky

(57) ABSTRACT

A performance testing apparatus for a heat pipe includes an immovable portion having a heating member located therein for heating an evaporating section of the heat pipe requiring test. A movable portion is capable of moving relative to the immovable portion. A receiving structure is defined between the immovable portion and the movable portion for receiving the evaporating section of the heat pipe therein. At least one temperature sensor is attached to at least one of the immovable portion and the movable portion to detect the temperature of the evaporating section of the heat pipe. An enclosure encloses the immovable portion and the movable portion therein and has sidewalls thereof slidably contacting at least one of the immovable portion and the movable portion.

17 Claims, 7 Drawing Sheets

PERFORMANCE TESTING APPARATUS FOR HEAT PIPES

FIELD OF THE INVENTION

The present invention relates generally to testing apparatuses, and more particularly to a performance testing apparatus for heat pipes.

DESCRIPTION OF RELATED ART

It is well known that a heat pipe is generally a vacuum-sealed pipe. A porous wick structure is provided on an inner face of the pipe, and phase changeable working media employed to carry heat is included in the pipe. Generally, according to where the heat is input or output, a heat pipe has three sections, an evaporating section, a condensing section and an adiabatic section between the evaporating section and the condensing section.

In use, the heat pipe transfers heat from one place to another place mainly by exchanging heat through phase change of the working media. Generally, the working media is a liquid such as alcohol or water and so on. When the working media in the evaporating section of the heat pipe is heated up, it evaporates, and a pressure difference is thus produced between the evaporating section and the condensing section in the heat pipe. The resultant vapor with high enthalpy rushes to the condensing section and condenses there. Then the condensed liquid reflows to the evaporating section along the wick structure. This evaporating/condensing cycle continually transfers heat from the evaporating section to the condensing section. Due to the continual phase change of the working media, the evaporating section is kept at or near the same temperature as the condensing section of the heat pipe. Heat pipes are used widely owing to their great heat-transfer capability.

In order to ensure the effective working of the heat pipe, the heat pipe generally requires testing before being used. The maximum heat transfer capacity (Qmax) and the temperature difference ($\Delta T$) between the evaporating section and the condensing section are two important parameters in evaluating performance of the heat pipe. When a predetermined quantity of heat is input into the heat pipe through the evaporating section thereof, thermal resistance (Rth) of the heat pipe can be obtained from $\Delta T$, and the performance of the heat pipe can be evaluated. The relationship between these parameters Qmax, Rth and $\Delta T$ is $Rth=\Delta T/Qmax$. When the input quantity of heat exceeds the maximum heat transfer capacity (Qmax), the heat cannot be timely transferred from the evaporating section to the condensing section, and the temperature of the evaporating section increases rapidly.

A typical method for testing the performance of a heat pipe is to first insert the evaporating section of the heat pipe into a liquid at constant temperature; after a period of time the temperature of the heat pipe will become stable, then a temperature sensor such as a thermocouple, a resistance thermometer detector (RTD) or the like can be used to measure $\Delta T$ between the liquid and the condensing section of the heat pipe to evaluate the performance of the heat pipe. However, Rth and Qmax can not be obtained by this test, and the performance of the heat pipe can not be reflected exactly by this test.

Referring to FIG. 7, a related performance testing apparatus for heat pipes is shown. The apparatus has a resistance wire 1 coiling round an evaporating section 2*a* of a heat pipe 2, and a water cooling sleeve 3 functioning as a heat sink and enclosing a condensing section 2*b* of the heat pipe 2. In use, electrical power controlled by a voltmeter and an ammeter flows through the resistance wire 1, whereby the resistance wire 1 heats the evaporating section 2*a* of the heat pipe 2. At the same time, by controlling flow rate and temperature of cooling liquid entering the cooling sleeve 3, the heat input at the evaporating section 2*a* can be removed from the heat pipe 2 by the cooling liquid at the condensing section 2*b*, whereby a stable operating temperature of adiabatic section 2*c* of the heat pipe 2 is obtained. Therefore, Qmax of the heat pipe 2 and $\Delta T$ between the evaporating section 2*a* and the condensing section 2*b* can be obtained by temperature sensors 4 at different positions on the heat pipe 2.

However, in the test, the related testing apparatus has the following drawbacks: a) it is difficult to accurately determine lengths of the evaporating section 2*a* and the condensing section 2*b* which are important factors in determining the performance of the heat pipe 2; b) heat transference and temperature measurement may easily be affected by environmental conditions; and, c) it is difficult to achieve sufficiently intimate contact between the heat pipe and the heat source and between the heat pipe and the heat sink, which results in uneven performance test results of the heat pipe. Furthermore, due to awkward and laborious assembly and disassembly in the test, the testing apparatus can be only used in the laboratory, and can not be used in the mass production of heat pipes.

In mass production of heat pipes, a large number of performance tests are needed, and the apparatus is used frequently over a long period of time; therefore, the apparatus not only requires good testing accuracy, but also requires easy and accurate assembly to the heat pipes to be tested. The testing apparatus affects the yield and cost of the heat pipes directly; therefore, testing accuracy, facility, speed, consistency, reproducibility and reliability need to be considered when choosing the testing apparatus. Therefore, the related testing apparatus needs to be improved in order to meet the demand for mass production of heat pipes.

What is needed, therefore, is a high performance testing apparatus for heat pipes suitable for use in mass production of heat pipes.

SUMMARY OF THE INVENTION

A performance testing apparatus for a heat pipe in accordance with a preferred embodiment of the present invention comprises an immovable portion having a heating member located therein for heating an evaporating section of the heat pipe requiring test. A movable portion is capable of moving relative to the immovable portion. A receiving structure is defined between the immovable portion and the movable portion for receiving the evaporating section of the heat pipe therein. At least one temperature sensor is attached to at least one of the immovable portion and the movable portion to detect the temperature of the evaporating section of the heat pipe. An enclosure encloses the immovable portion and the movable portion and has sidewalls thereof slidably contacting at least one of the immovable portion and the movable portion.

Other advantages and novel features will become more apparent from the following detailed description of preferred embodiments when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
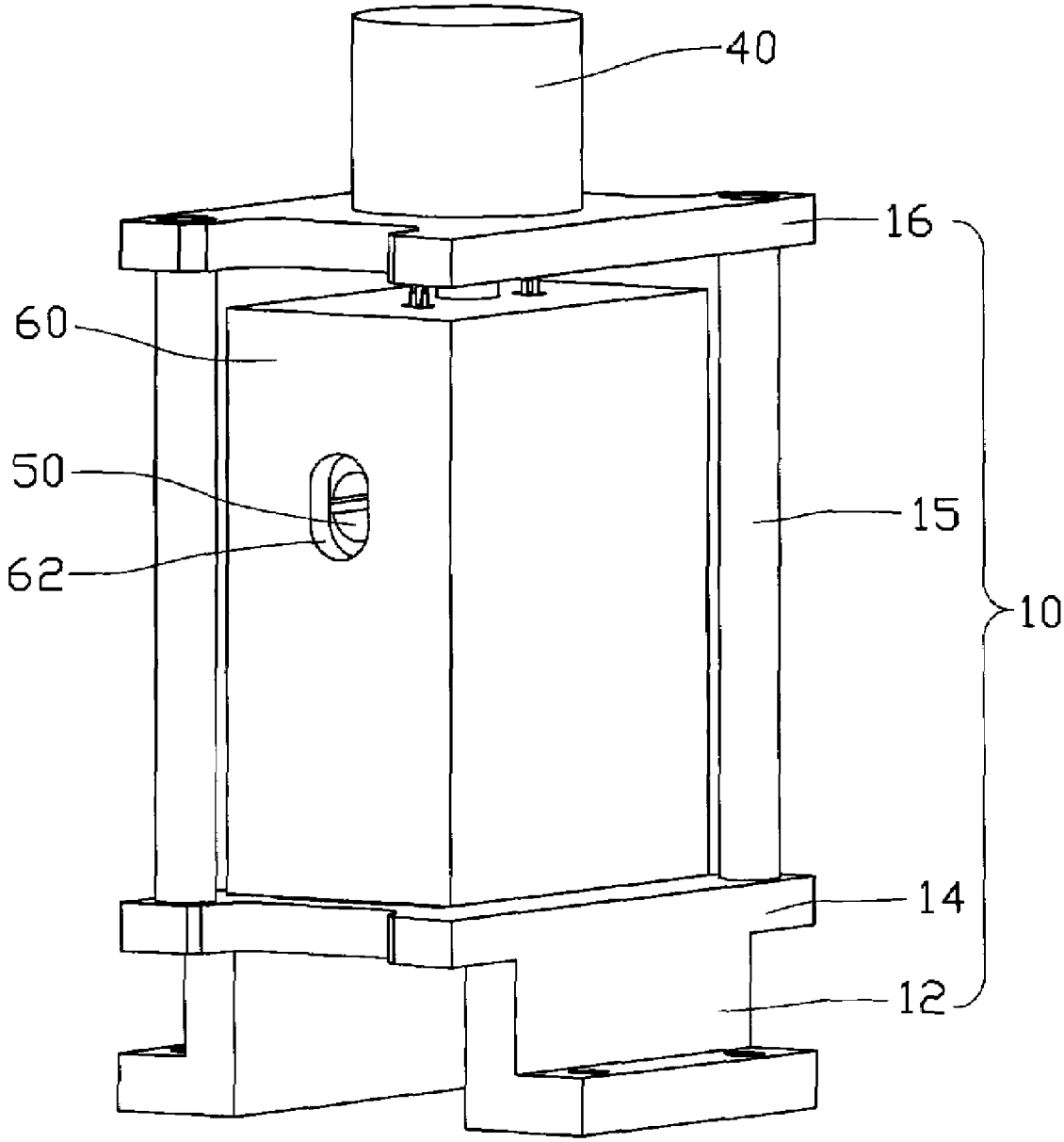
FIG. 1 is an assembled view of a performance testing apparatus for heat pipes in accordance with a preferred embodiment of the present invention.
Figure 2:
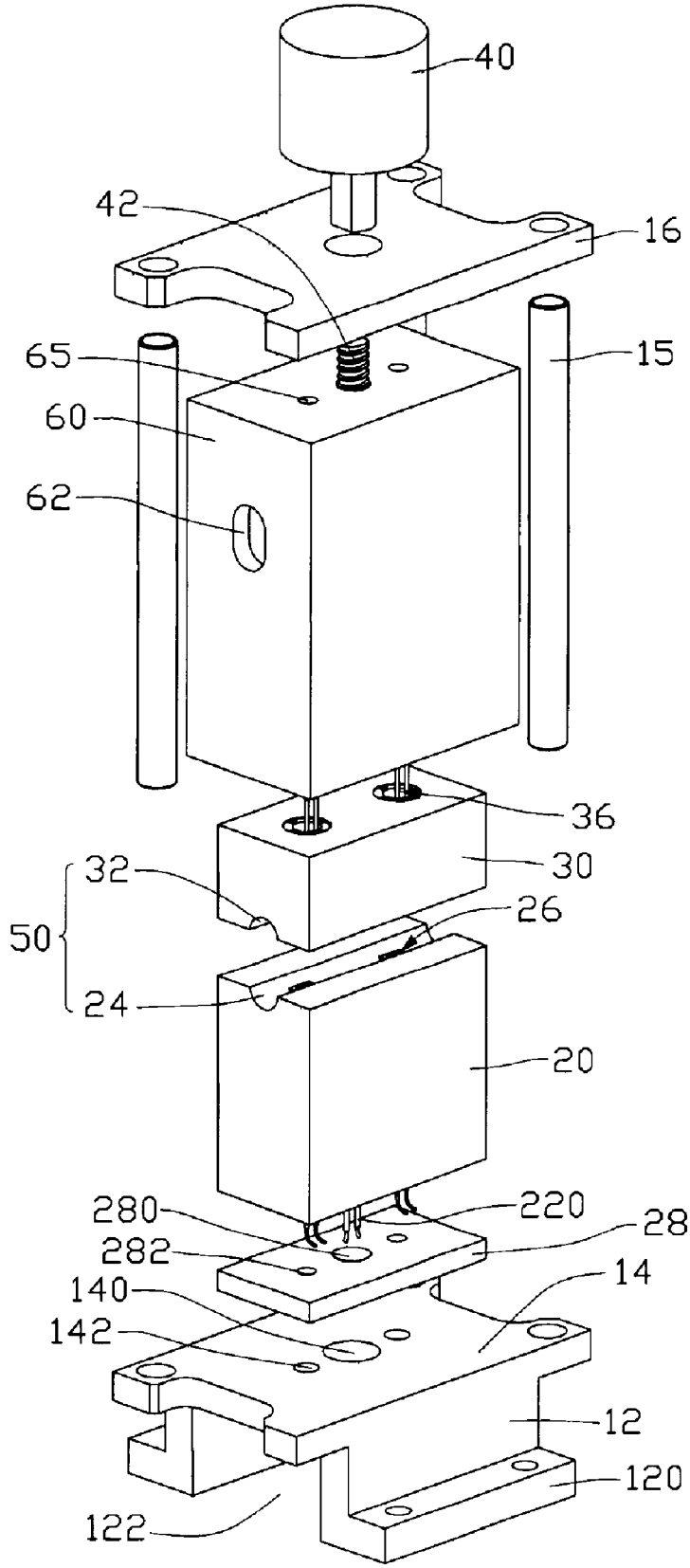
FIG. 2 is an exploded, isometric view of the testing apparatus of FIG. 1.

Referring to FIGS. 1 and 2, a performance testing apparatus for heat pipes comprises an immovable portion 20 and a movable portion 30 movably mounted on the immovable portion 20.

The immovable portion 20 is made of metal having good heat conductivity. A heating member (not shown) such as an immersion heater, resistance coil, quartz tube and Positive temperature coefficient (PTC) material or the like is embedded in the immovable portion 20. The immovable portion 20 defines a hole (not shown) through a center of a bottom thereof. In the case, the heating member is an elongated cylinder. The heating member is accommodated in the hole of the immovable portion 20. Two spaced wires 220 extend from a bottom end of the heating member to connect with a power supply (not shown). The immovable portion 20 has a heating groove 24 defined in a top face thereof, for receiving an evaporating section of the heat pipe to be tested therein. Two temperature sensors 26 are inserted into the immovable portion 20 from a bottom thereof so as to position detecting portions (not labeled) of the sensors 26 in the heating groove 24. The detecting portions are capable of automatically contacting the heat pipe in order to detect a temperature of the evaporating section of the heat pipe.

The movable portion 30, corresponding to the heating groove 24 of the immovable portion 20, has a positioning groove 32 defined therein, whereby a testing channel 50 is cooperatively defined by the heating groove 24 and the positioning groove 32 when the movable portion 30 moves to reach the immovable portion 20. Thus, an intimate contact between the heat pipe and the movable and immovable portions 30, 20 defining the channel 50 can be realized, thereby reducing heat resistance between the heat pipe and the movable and immovable portions 30, 20. Two temperature sensors 36 are inserted into the movable portion 30 from a top thereof to reach a position wherein detecting portions (not shown) of the sensors 36 are located in the positioning groove 32. The detecting portions are capable of automatically contacting the heat pipe to detect the temperature of the evaporating section of the heat pipe.

The channel 50 as shown in the preferred embodiment has a circular cross section enabling it to receive the evaporating section of the heat pipe having a correspondingly circular cross section. Alternatively, the channel 50 can have a rectangular cross section where the evaporating section of the heat pipe also has a flat rectangular configuration.

In order to ensure that the heat pipe is in close contact with the movable and immovable portions 30, 20, a supporting frame 10 is used to support and assemble the immovable and movable portions 20, 30. The immovable portion 20 is fixed on the supporting frame 10. A driving device 40 is installed on the supporting frame 10 to drive the movable portion 30 to make accurate linear movement relative to the immovable portion 20 along a vertical direction, thereby realizing the intimate contact between the heat pipe and the movable and immovable portions 30, 20. In this manner, heat resistance between the evaporating section of the heat pipe and the movable and immovable portions 30, 20 can be minimized.

The supporting frame 10 comprises a seat 12, by which the testing apparatus can be easily placed at any desired position. The seat 12 comprises a first plate 14 at a top thereof and a pair of feet 120 depending from the first plate 14. A space 122 is defined between the pair of feet 120 for extension of wires (not labeled) of the temperature sensors 26 and the wires 220 of the heating member. A second plate 16 hovers over the first plate 14. Pluralities of supporting rods 15 interconnect the first and second plates 14, 16 for supporting the second plate 16 above the first plate 14. The seat 12, the second plate 16 and the rods 15 constitute the supporting frame 10 for assembling and positioning the immovable and movable portions 20, 30 therein. The immovable portion 20 is fixed on the first plate 14. In order to prevent heat in the immovable portion 20 from spreading to the first plate 14, a thermally insulating plate 28 is located at the bottom of the immovable portion 20. The first plate 14 and the insulating plate 28 define corresponding through holes 140, 280 for the wires 220 of the heating member of the immovable portion 20 to extend therethrough, and spaced apertures 142, 282 to allow the wires of the temperature sensors 26 to extend therethrough to connect with a monitoring computer (not shown).

Figure 3:
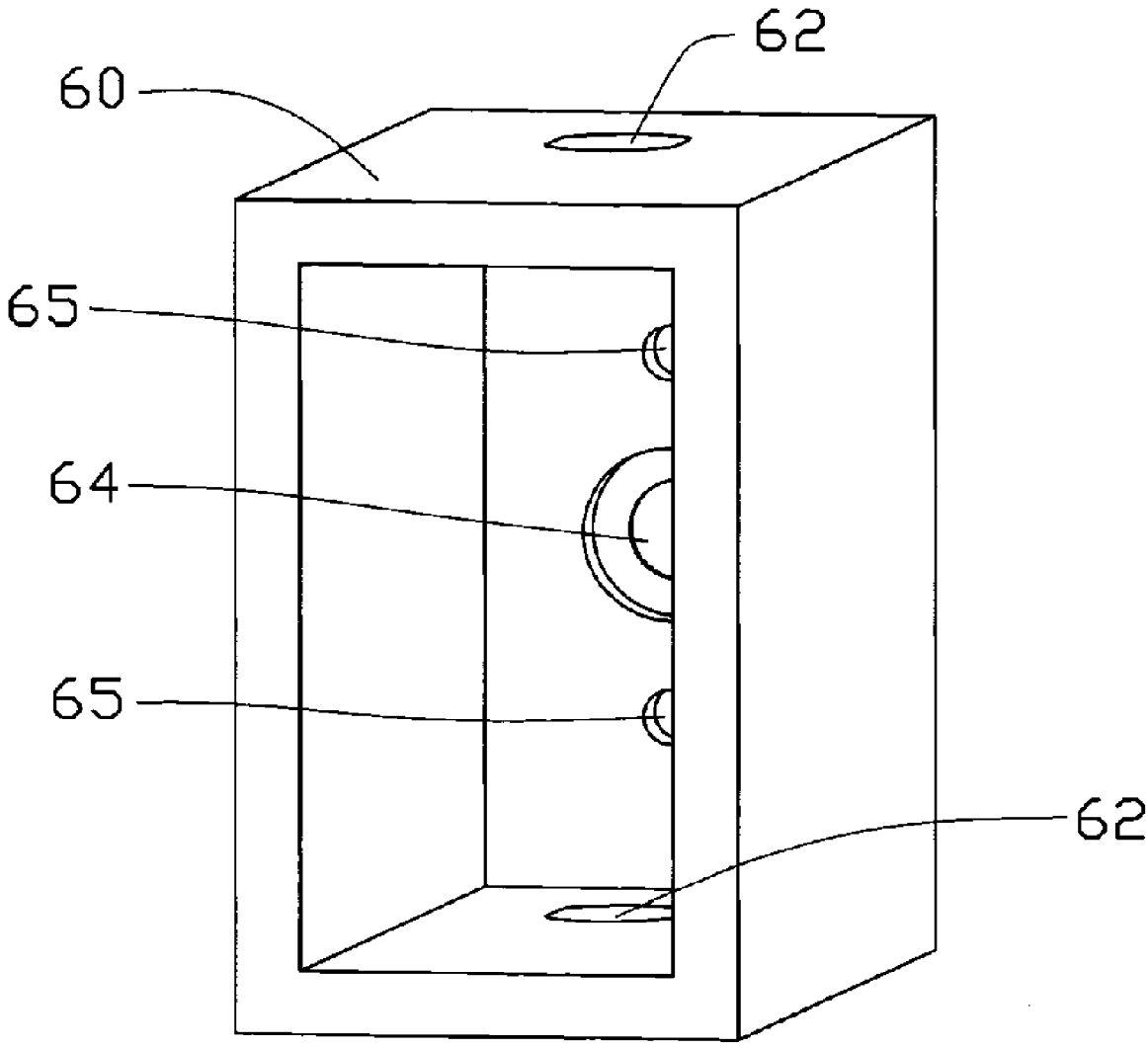
FIG. 3 shows an enclosure of the testing apparatus of FIG. 2, viewed from another aspect.

Referring also to FIG. 3, in order to ensure that the immovable portion 20 and the movable portion 30 have good linear movement relative to each other, and keep the grooves 24, 32 of the immovable and movable portions 20, 30 in positions corresponding to each other, a cuboidal enclosure 60 with an opened bottom covers the immovable and movable portions 20, 30 therein. The enclosure 60 is located between the first and second plates 14, 16 of the supporting frame 10. The enclosure 60 has four sidewalls (not labeled) thereof slidably contacting side faces of the immovable portion 20. A pair of sidewalls of the enclosure 60 each defines an opening 62 corresponding to the channel 50 between the immovable and movable portions 20, 30, for extension of the heat pipe into the channel 50 via the openings 62. A ceiling (not labeled) of the enclosure 60 contacts a top face of the movable portion 30 and defines therein a through hole 64. Two apertures 65 are defined at two sides of the through hole 64 in the ceiling to allow wires (not labeled) of the temperature sensors 36 to extend therethrough to connect with the monitoring computer.

The driving device 40 in this preferred embodiment is a step motor, although it can be easily apprehended by those skilled in the art that the driving device 40 can also be a pneumatic cylinder or a hydraulic cylinder. The driving device 40 is installed on the second plate 16 of the supporting frame 10. The driving device 40 is fixed to the second plate 16 above the movable portion 30. A shaft (not labeled) of the driving device 40 extends through the second plate 16 of the supporting frame 10. The shaft has a threaded end (not shown) threadedly engaging with a bolt 42 which is secured to the movable portion 30 and extends through the hole 64 of the ceiling of the enclosure 60. When the shaft rotates, the bolt 42 with the movable portion 30 and the enclosure 60 move upwardly or downwardly. In use, the driving device 40 accurately drives the movable portion 30 to move linearly relative to the immovable portion 20. For example, the movable portion 30 can be driven to depart a certain distance such as 5 millimeters from the immovable portion 20 to facilitate the insertion of the evaporating section of the heat pipe being tested into the channel 50 or withdrawn from the channel 50 after the heat pipe has been tested. On the other hand, the movable portion 30 can be driven to move toward the immovable portion 20 to thereby realize an intimate contact between the evaporating section of the heat pipe and the immovable and movable portions 20, 30 during the test. Accordingly, the requirements for testing, i.e. accuracy, ease of use and speed, can be realized by a testing apparatus in accordance with the present invention.

It can be understood, positions of the immovable portion 20 and the movable portion 30 can be exchanged, i.e., the movable portion 30 is located on the first plate 14 of the supporting frame 10, and the immovable portion 20 is fixed adjacent to the second plate 16 of the supporting frame 10, and the driving device 40 is positioned adjacent to the immovable portion 20. Alternatively, the driving device 40 can be installed to the immovable portion 20. Otherwise, each of the immovable and movable portions 20, 30 may have one driving device 40 installed thereon to move them toward/away from each other.

In use, the evaporating section of the heat pipe is disposed into the channel 50 from one of the openings 62 of the enclosure 60 when the movable portion 30 moves away from the immovable portion 20. Then the movable portion 30 moves to reach the immovable portion 20 so that the evaporating section of the heat pipe is tightly fitted into the channel 50. The sensors 26, 36 are in thermal contact with the evaporating section of the heat pipe; therefore, the sensors 26, 36 work to accurately send detected temperatures from the evaporating section of the heat pipe to the monitoring computer. Based on the temperatures obtained by the plurality of sensors 26, 36, an average temperature can be obtained by the monitoring computer very quickly; therefore, performance of the heat pipe can be quickly decided.

Figure 4:
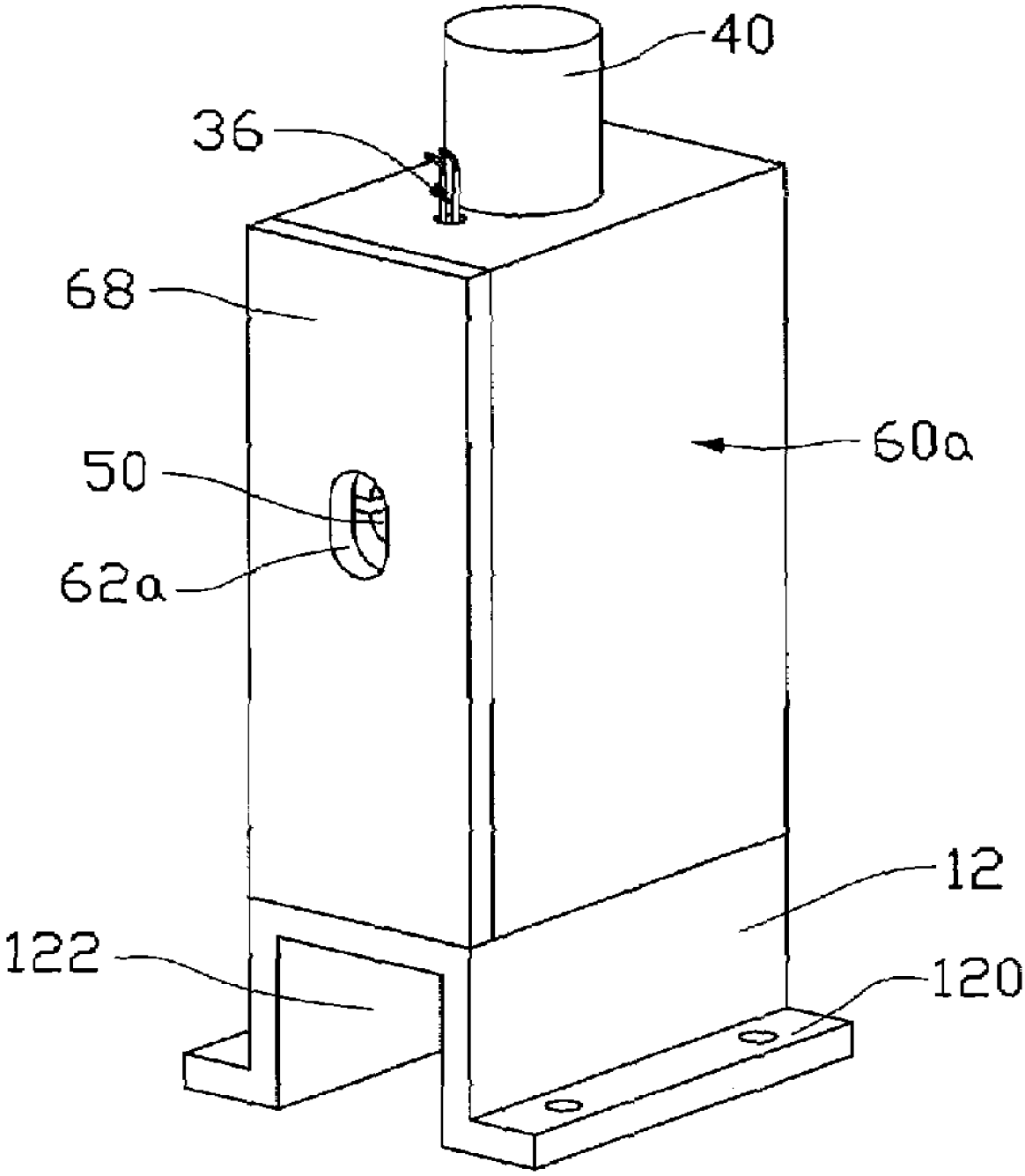
FIG. 4 is an assembled view of a performance testing apparatus for heat pipes in accordance with an alternative embodiment of the present invention.
Figure 5:
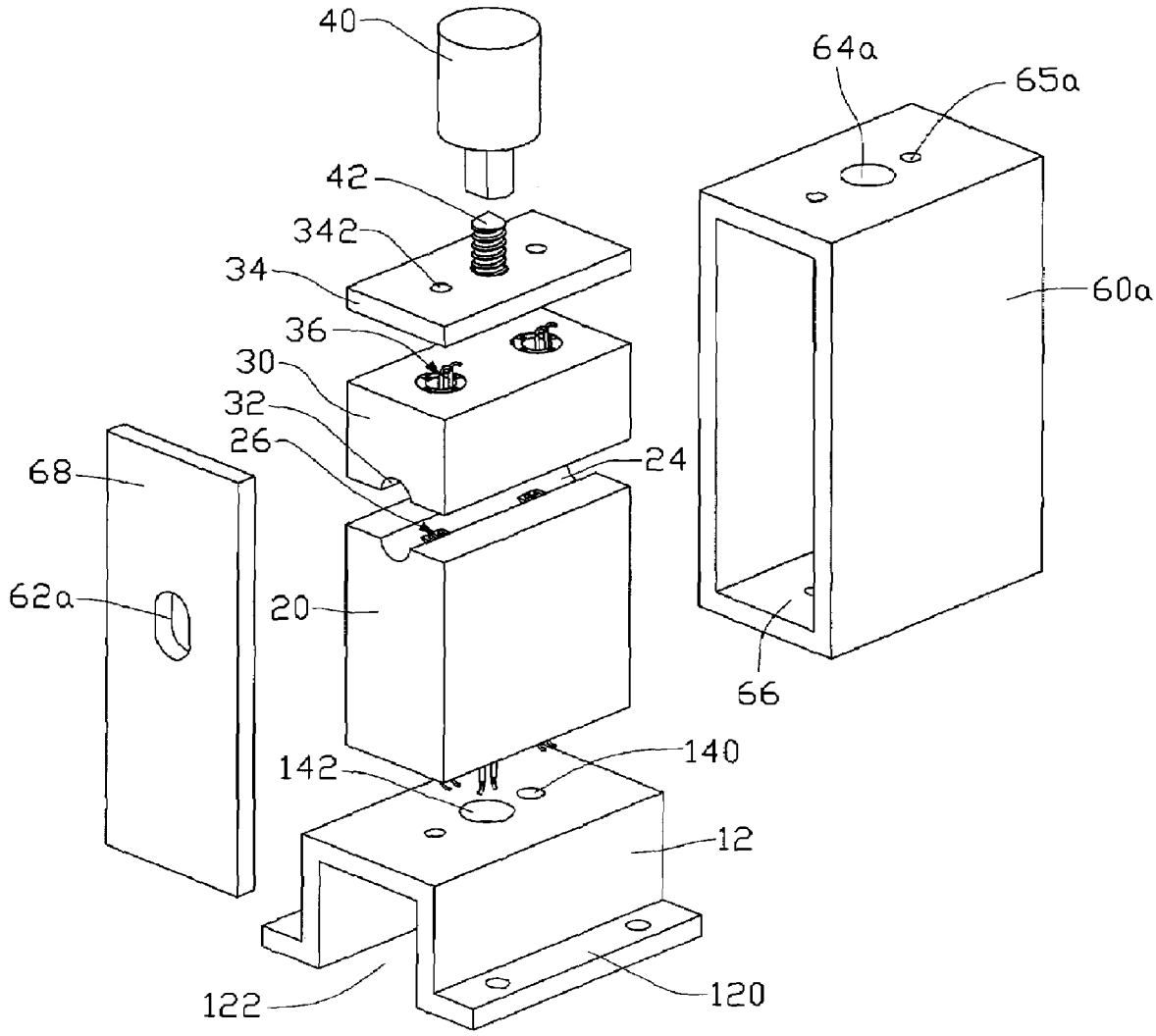
FIG. 5 is an exploded, isometric view of FIG. 4.
Figure 6:
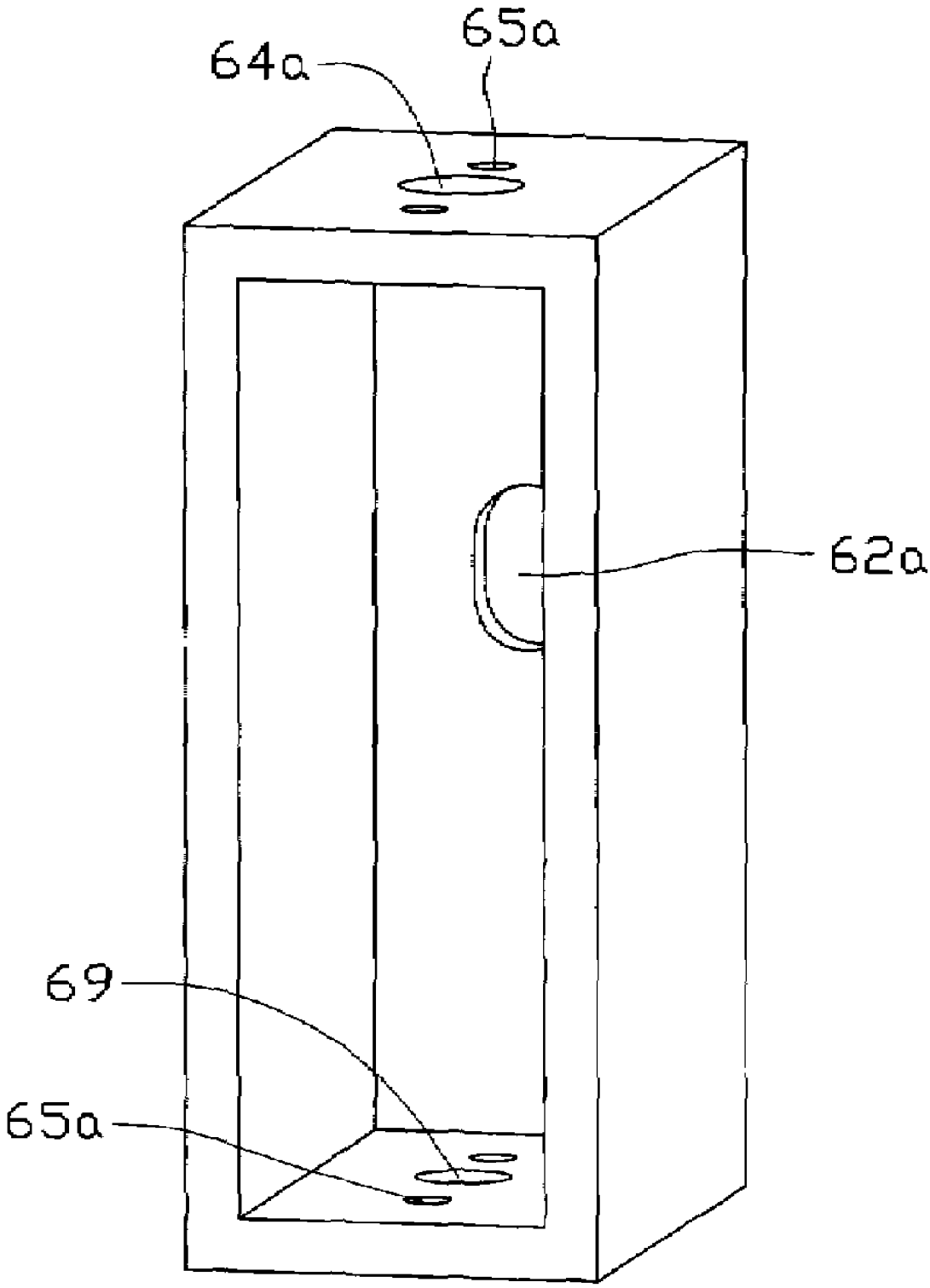
FIG. 6 shows an enclosure of the testing apparatus of FIG. 5, viewed from another aspect.
Figure 7:
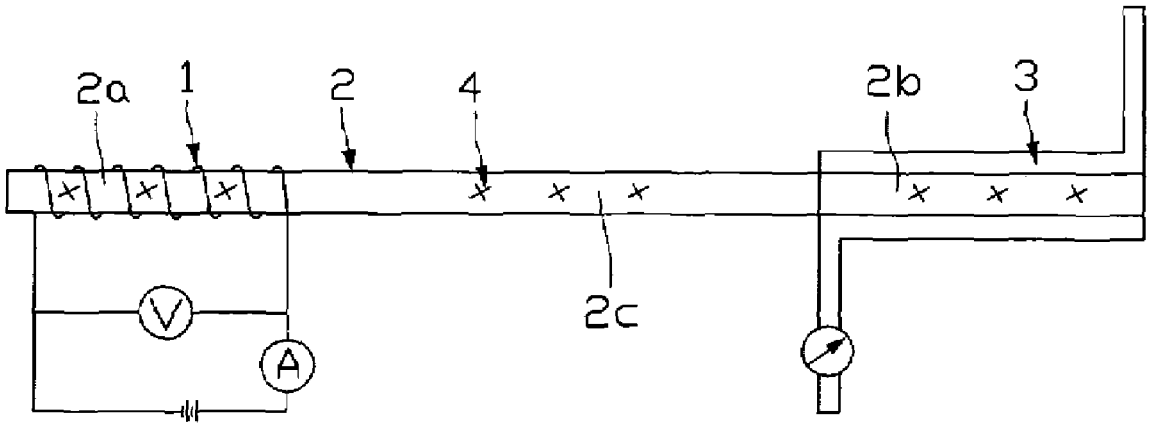
FIG. 7 (RELATED ART)
FIG. 7 is a performance testing apparatus for heat pipes in accordance with related art.

Referring to FIGS. 4-6, a performance testing apparatus for heat pipes in accordance with an alternative embodiment of the present invention is shown. The testing apparatus is similar to the preferred embodiment; the main difference therebetween is that an enclosure 60*a* further comprising a bottom wall 66 replaces the enclosure 60 and first and second plates 14, 16 of the supporting frame 10 of the first preferred embodiment. The enclosure 60*a* is directly positioned on the seat 12. An opening 62*a* is defined in one sidewall (not labeled) of the enclosure 60*a*. Opposite to the sidewall with the opening 62*a*, the enclosure 60*a* defines an entrance (not labeled) for disposing the movable portion 30 and the immovable portion 20 into the enclosure 60*a*. A door board 68 is attached to entrance after the immovable portion 20 and the movable portion 30 are located in the enclosure 60*a*. The door board 68 also defines an opening 62*a* corresponding to the channel 50 between the immovable portion 20 and the movable portion 30 and the opening 62*a* of the sidewall of the enclosure 60*a*. A ceiling (not labeled) of the enclosure 60*a* defines a through hole 64*a* for the shaft of the driving device 40 extending therethrough. Two apertures 65*a* are defined at two sides of the through hole 64*a* in the ceiling to allow wires (not labeled) of the temperature sensors 36 to extend therethrough to connect with the monitoring computer. The bottom wall 66 defines two through apertures 65*a* to allow wires of the temperature sensors 26 to extend therethrough to connect with the monitoring computer, and a central hole 69 to allow the wires 220 of the heating member of the immovable portion 20 to extend therethrough to connect with the power supplier. The driving device 40 is fixed to the ceiling of the enclosure 60*a*. The shaft of the driving device 40 extends through the hole 64*a* and threadedly engages with the bolt 42 secured to a board 34 of the movable portion 30. The board 34 is fixed atop the movable portion 30 and defines two apertures 342 through which the wires of the temperature sensors 36 extend. A space is left between the board 34 and the ceiling of the enclosure 60*a* for movement of the movable portion 30. When the driving device 40 operates, the shaft rotates, and the bolt 42, the board 34 and the movable portion 30 move upwardly or downwardly relative to the immovable portion 20 in the enclosure 60*a*.

Additionally, in the present invention, in order to lower cost of the testing apparatus, the movable portion 30, the insulating plate 28, the board 34 and the enclosure 60, 60*a* can be made from low-cost material such as PE (Polyethylene), ABS (Acrylonitrile Butadiene Styrene), PF(Phenol-Formaldehyde), PTFE (Polytetrafluoroethylene) and so on. The immovable portion 20 can be made from copper (Cu) or aluminum (Al). The immovable portion 20 can have silver (Ag) or nickel (Ni) plated on an inner face defining the groove 24 to prevent the oxidization of the inner face.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A performance testing apparatus for a heat pipe comprising:

an immovable portion having a heating member located therein for heating an evaporating section of the heat pipe;

a movable portion capable of moving relative to the immovable portion;

a receiving structure being defined between the immovable portion and the movable portion for receiving the evaporating section of the heat pipe therein;

at least one temperature sensor being attached to at least one of the immovable portion and the movable portion for thermally contacting the heat pipe in the receiving structure for detecting temperature of the heat pipe; and an enclosure enclosing the immovable portion and the movable portion therein and having sidewalls thereof slidably contacting at least one of the immovable portion and the movable portion.

2. The testing apparatus of claim 1, wherein the receiving structure is a channel defined between the immovable portion and the movable portion.

3. The testing apparatus of claim 2, wherein the channel is cooperatively defined by a heating groove defined in a face of the immovable portion and a positioning groove defined in a face of the movable portion.

4. The testing apparatus of claim 2, wherein the at least a temperature sensor has a detecting section thereof exposed to the channel.

5. The testing apparatus of claim 2, wherein the enclosure has at least one of the sidewalls thereof defining an opening corresponding to the channel for extension of the heat pipe into the channel via the opening.

6. The testing apparatus of claim 2 further comprising a supporting frame having a seat for locating the testing apparatus at a required position.

7. The testing apparatus of claim 6, wherein the seat has a first plate on which the immovable portion is located, and wherein the supporting frame comprises a second plate located above the movable portion and supported by a plurality rods extending from the first plate.

8. The testing apparatus of claim 7, wherein the immovable portion is positioned on the first plate, the enclosure is located between the first and second plates of the supporting frame, and has a ceiling thereof contacting the movable portion.

9. The testing apparatus of claim 8, wherein the enclosure has the sidewalls thereof slidably contacting side faces of the immovable portion.

10. The testing apparatus of claim 8 further comprising a driving device for driving the movable portion to move away and toward the immovable portion, wherein the driving device is mounted on the second plate of the supporting frame and connects with the movable portion and the ceiling of the enclosure via a bolt.

11. The testing apparatus of claim 8, wherein an insulating plate is sandwiched between the immovable portion and the first plate of the supporting frame.

12. The testing apparatus of claim 6, wherein the enclosure has a bottom wall sitting on the seat of the supporting frame, and a ceiling thereof positioned over the movable portion.

13. The testing apparatus of claim 12, wherein the enclosure has one of the sidewalls thereof defining an opening corresponding to the channel for extension of the heat pipe into the channel via the opening.

14. The testing apparatus of claim 13 further comprising a driving device located on a ceiling of the enclosure, wherein the driving device engaging with a bolt secured to a board fixed to the movable portion, and wherein a space is left between the ceiling and the board for movement of the movable portion.

15. The testing apparatus of claim 13, wherein the enclosure has a door board attached thereto, the door board defining an opening corresponding to the channel for extension the heat pipe into the channel via the opening of the door board.

16. The testing apparatus of claim 1, wherein the heating member of the immovable portion is accommodated in a hole defined in the immovable portion, and extends two wires to connect with a power supplier.

17. The testing apparatus of claim 16, wherein immovable portion sits on a bottom of the enclosure, the two wires of the heating member extending through the bottom of the enclosure.

* * * * *